US007834901B2

(12) United States Patent
Ueno

(10) Patent No.: US 7,834,901 B2
(45) **Date of Patent: *Nov. 16, 2010**

(54) IMAGE FORMING APPARATUS WHICH EXECUTES AN IMAGE QUALITY CONTROL

(75) Inventor: Sueo Ueno, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 461 days.

This patent is subject to a terminal disclaimer.

(21) Appl. No.: 11/889,773

(22) Filed: Aug. 16, 2007

(65) Prior Publication Data

US 2007/0296801 A1 Dec. 27, 2007

Related U.S. Application Data

(63) Continuation of application No. 10/985,872, filed on Nov. 12, 2004, now Pat. No. 7,268,798.

(30) Foreign Application Priority Data

Nov. 18, 2003 (JP) ..... 2003-388013

(51) Int. Cl.
*B41J 15/14* (2006.01)
*B41J 27/00* (2006.01)

(52) U.S. Cl. ..... 347/243; 347/261

(58) Field of Classification Search ..... 347/243, 347/231, 240, 251–254, 259–261; 399/49
See application file for complete search history.

(56) References Cited

U.S. PATENT DOCUMENTS

| | | | | |
|---|---|---|---|---|
| 5,734,390 | A | 3/1998 | Sakaizawa et al. | |
| 6,240,264 | B1 | 5/2001 | Yajima et al. | |
| 6,463,227 | B1 * | 10/2002 | Denton et al. | 399/49 |
| 6,804,479 | B2 * | 10/2004 | Kimura | 399/49 |
| 7,027,139 | B2 * | 4/2006 | Ogihara et al. | 356/218 |
| 7,058,324 | B2 * | 6/2006 | Shibuya et al. | 399/49 |
| 7,268,798 | B2 * | 9/2007 | Ueno | 347/243 |
| 2002/0033873 | A1 | 3/2002 | Okano et al. | |
| 2002/0041769 | A1 * | 4/2002 | Nakai et al. | 399/49 |
| 2003/0194246 | A1 * | 10/2003 | Hayashi et al. | 399/69 |
| 2004/0208670 | A1 * | 10/2004 | Abe | 399/110 |

FOREIGN PATENT DOCUMENTS

| | | | |
|---|---|---|---|
| JP | 2-238963 | A | 9/1990 |
| JP | 4-28549 | A | 1/1992 |
| JP | 4-185361 | A | 7/1992 |
| JP | 06-175449 | A | 6/1994 |
| JP | 8-069217 | A | 3/1996 |
| JP | 11-334139 | A | 12/1999 |
| JP | 2002-296851 | A | 10/2002 |
| JP | 2002-326386 | A | 11/2002 |

* cited by examiner

*Primary Examiner*—Hai C Pham
(74) *Attorney, Agent, or Firm*—Foley & Lardner LLP

(57) ABSTRACT

The present invention uses a pattern that enables image quality maintaining control to be performed at a resolution lower than that used for a normal image forming process. Thus, during an initial operation upon power-on, the image quality maintaining control is performed at the resolution lower than that used for the normal image forming process.

16 Claims, 5 Drawing Sheets

IMAGE FORMING APPARATUS WHICH EXECUTES AN IMAGE QUALITY CONTROL

CROSS-REFERENCE TO RELATED APPLICATIONS

This application is a continuation of U.S. patent application Ser. No. 10/985,872, filed Nov. 12, 2004, which is based upon and claims the benefit of priority from prior Japanese Patent Application No. 2003-388013, filed Nov. 18, 2003, the entire contents of which are incorporated herein by reference.

BACKGROUND OF THE INVENTION

1. Field of the Invention

The present invention to an image forming apparatus that forms an image by for example, using a polyhedral mirror to scan a laser light corresponding to image data over an image carrier in a main scanning direction to form a latent image on the image carrier and then developing the latent image, as well as a method of controlling image quality provided by the image forming apparatus.

2. Description of the Related Art

In recent years, image forming apparatuses such as color copiers have been popular which read a color image from a document and which then print the color image on paper. Conventional color copiers handle image data of three primary colors such as red (R), green (G), and blue (B). They thus require a longer operation time than monochromatic copiers.

In particular, the conventional color copier requires nearly three times as long a time as the monochromatic copier to complete a warm-up operation performed when a power source is started up (an operation of making the entire copier ready for an image forming process). For example, if a user using a monochromatic copier newly introduces a color copier, the user may feel that he or she must wait for a long time during a warm-up operation performed upon power-on. This impairs productivity.

BRIEF SUMMARY OF THE INVENTION

The present invention is made to solve the above problems. It is an aspect of an embodiment of the present invention to provide an image forming apparatus that can reduce the time required for a warm-up operation to improve productivity, as well as a method of controlling image quality provided by the image forming apparatus.

According to an embodiment of the present invention, there is provided an image forming apparatus which executes an image quality control. The image forming apparatus includes a light emitter which emits a laser light on a basis of the image quality control and a polygon mirror which reflects the laser light emitted by the light emitter. A polygon motor rotatively drives the polygon mirror and an image carrier, on which an image quality control pattern formed by the laser light scanned in a main direction using the polygon mirror, is rotatively driven by the polygon motor. A developing member develops the image control pattern formed on the image carrier, and a sensor detects the image control pattern developed by the developing member to control the image quality. A control section is provided which controls the polygon motor to rotate the polygon mirror at a rotation speed corresponding to a resolution for image quality control lower than the resolution for image formation.

According to an embodiment of the present invention, there is provided a method of controlling image quality of an image forming apparatus. The method includes emitting a laser light by a light emitter on a basis of the image quality control; reflecting the laser light by a polygon mirror, driving the polygon mirror rotatively by a polygon motor and forming an image quality control pattern on an image carrier by the laser light scanned in a main scanning direction using the polygon mirror rotatively driven by the polygon motor. The method also includes developing the image control pattern formed on the image carrier by a developing member, detecting the image control pattern by a sensor to control image quality, and controlling the polygon motor to rotate the polygon mirror at a rotation speed corresponding to a resolution for image quality control lower than the resolution for image formation.

Additional advantages of the invention will be set forth in the description which follows, and in part will be obvious from the description, or may be learned by practice of the invention. The advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 3 is a flow chart illustrating the procedure of a warm-up operation performed when a color copier is powered on;

FIG. 4 is a flow chart illustrating the procedure of an initial operation performed by a printer section when the color printer is powered on;

DETAILED DESCRIPTION OF THE INVENTION

With reference to the drawings, description will be given below of the best mode for carrying out the present invention.

Figure 1:
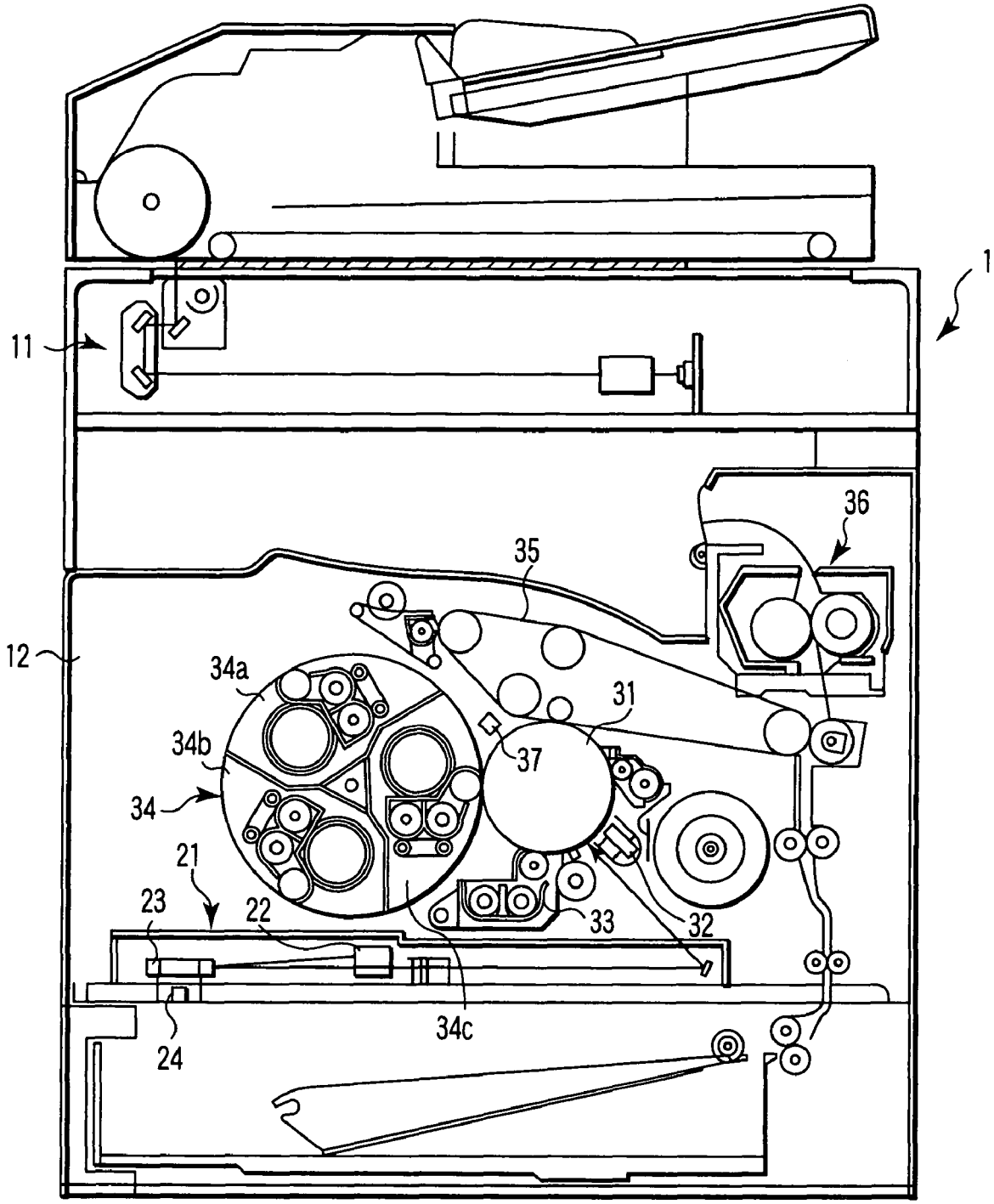
FIG. 1 is a sectional view showing the internal configuration of a color copier according to an embodiment of the present invention.

FIG. 1 is a sectional view showing the internal configuration of a color copier 1 serving as an image forming apparatus employing an electrophoto-graphic system according to an embodiment of an image forming apparatus according to the present invention. The color copier 1 has a scanner section 11 and a printer section 12. The scanner section 11 reads image information retained by a copy target (document) to generate an image signal. The printer section 12 forms an image corresponding to an image signal supplied by the scanner section 11 or an external source.

The scanner section 11 optically reads an image from a document and converts the image into image data. The scanner section 11 then stores the converted data in an image memory (not shown). Further, the scanner section 11 has a function to monochromatically read a document and a function to read a document in colors. For example, if the scanner section 11 reads an image from a document in colors, it reads a plurality of color components of the image from the document. The scanner section 11 then converts each of the color components into image data.

The printer section 12 forms an image monochromatically or in colors on paper used as an image formed medium, the image being stored in the image memory. A brief description will be given below of the configuration and operation of the printer section 12 during an image forming process.

If the printer section 12 executes an image forming process, an exposure device 21 irradiates a predetermined position of a photosensitive drum (image carrier) 31 with an exposure light (laser light) based on the image data stored in the image memory. Thus, an electrostatic latent image is formed on the photosensitive drum 31 charged by a charger 32 to a bias voltage. The electrostatic latent image corresponds to the intensity of an exposure light applied by the exposure device 21. The exposure device 21 is composed of a laser light emitter 22, a polygon mirror 23, a polygon motor 24, and the like. The laser emitter 22 emits a laser light based on image data. The polygon mirror 23 includes a polyhedral mirror that reflects a light emitted by the laser light emitter 22. The polygon motor 24 rotatively drives the polygon mirror 23.

A latent image formed on the photosensitive drum 31 is visualized (developed) as a toner image using a toner selectively supplied by a black developing device 33 or a color developing device 34. The black developing device 33 develops a latent image in a single color, black. The color developing device 34 develops a latent image in three single colors, cyan, magenta, and yellow. Further, the color developing device 34 is composed of a cyan developing member 34*a* that develops an image in cyan, a magenta developing member 34*b* that develops an image in magenta, and a yellow developing member 34*c* that develops an image in yellow.

A toner image on the photosensitive drum 31 is transferred to a transfer belt 35 serving as an intermediate transfer member. The toner image transferred to the transfer belt 35 is transferred, at a predetermined transfer position, to paper used as an image formed medium. The paper to which the toner image has been transferred is further conveyed to a fixing device 36. The fixing device 36 melts and fixes the toner constituting the toner image on the paper by supplying a predetermined amount of heat to the paper to which the toner image has been transferred, while pressurizing the paper. This allows the toner image to be fixed to the paper.

Further, an image quality maintaining sensor 37 is provided opposite the photosensitive drum 31 to detect the quality of an image developed on the photosensitive drum 31. The image quality maintaining sensor 37 detects the density of the image developed on the basis of the level of a reflected light from the photosensitive drum 31 retaining the image.

In the present embodiment, the image quality maintaining sensor 37 detects the density of the image formed on the photosensitive drum 31. The image quality maintaining sensor 37 may be installed opposite the transfer belt 35, serving as an intermediate transfer member, to detect the density of an image formed on the transfer belt 35.

Figure 2:
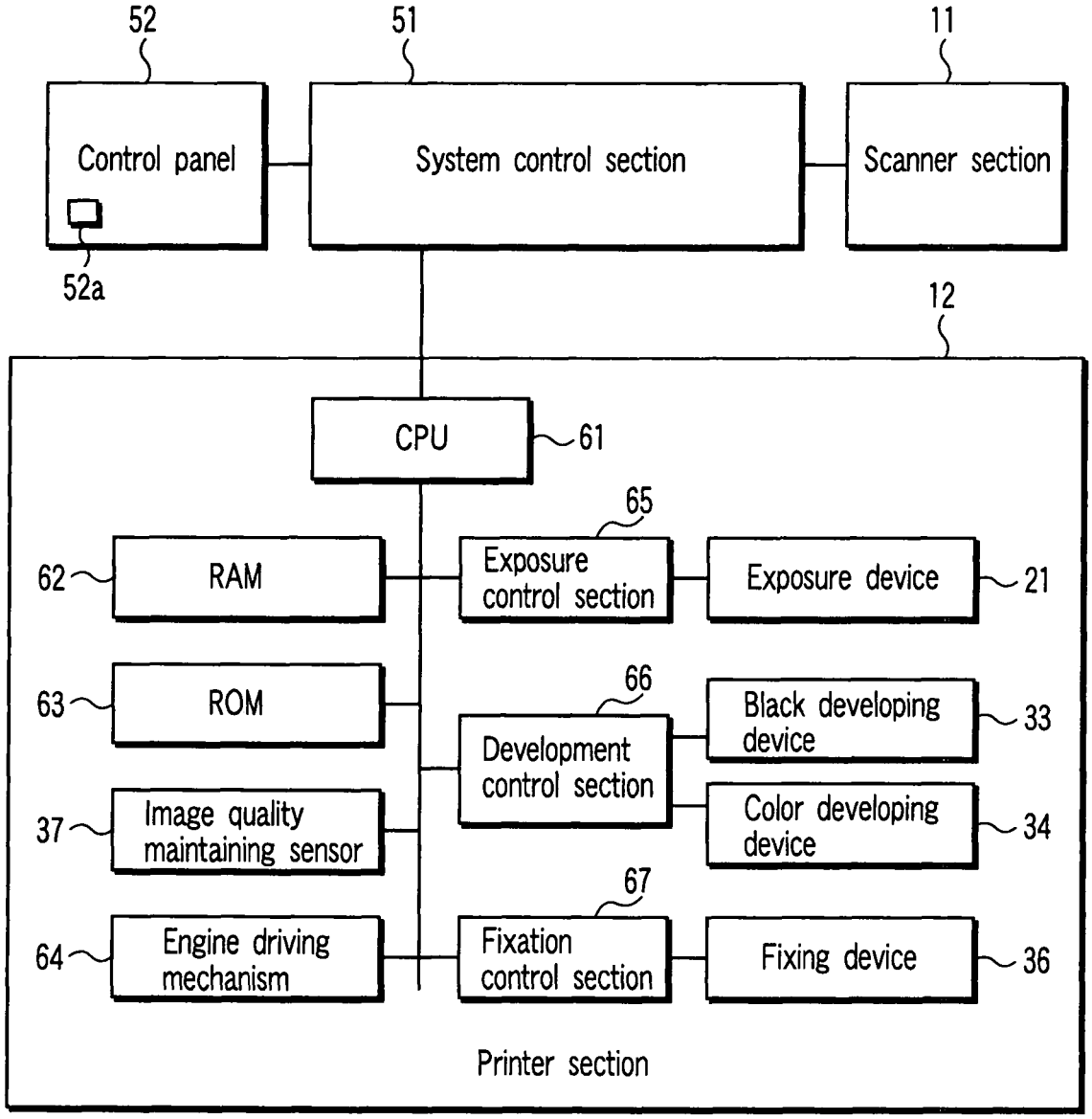
FIG. 2 is a block diagram showing the configuration of a control system in a color copier.

FIG. 2 is a block diagram showing the configuration of a control system in the color copier 1.

As shown in FIG. 2, the system of the color copier 1 is composed of a system control section 51, a control panel 52, a scanner section 11, and a printer section 12.

The system control section 51 controls the entire color copier 1. The system control section 51 has, for example, a ROM in which control programs and control data are stored, a RAM in which various parameters, work data, and the like are stored, an image processing section that processes images, a page memory, a hard disk drive, and an external interface that executes data communication with external apparatuses.

The control panel 52 includes, for example, a liquid crystal display device containing a touch panel. The control panel 52 is installed on a front surface of the color copier 1. The control panel 52 inputs operational instructions from a user to the apparatus and displays guidance to the user. The control panel 52 is also provided with, for example, a power key 52*a* used to power on the color copier 1.

The scanner section 11 includes a CPU (not shown), a CCD sensor (not shown), a CCD driver (not shown), a signal processing circuit (not shown), a scan motor (not shown), an exposure lamp (not shown), and the like.

The CPU controls the operation of the entire scanner section 11 and operates in response to operational instructions from the system control section 51. The CCD sensor is a photoelectric converting element that photoelectrically converts an image on a document on the basis of the lightness of a light from the image. The CCD driver drives the CCD sensor. The signal processing circuit processes the signal obtained by the photoelectric conversion by the CCD sensor. The scan motor drives a movement mechanism such as a carriage on which is mounted, for example, the exposure lamp and an optical system guiding a reflected light from a document to the CCD sensor. The exposure lamp exposes a read surface of the document.

Besides the arrangements shown in FIG. 1, the printer section 12 has a CPU 61, a RAM 62, a ROM 63, an engine driving mechanism 64, an exposure control section 65, a development control section 66, a fixation control section 67, and the like.

The CPU (control section) 61 controls the operation of the entire printer section 12. The CPU 61 connects to the RAM 62, the ROM 63, the engine driving mechanism 64, the exposure control section 65, the development control section 66, the fixation control section 67, and the like.

The ROM 63 stores control programs executed by the CPU 61 as well as control data. The RAM temporarily stores data such as image formation conditions and control data. The engine driving mechanism 64 drives a driving motor (not shown) that drives various rollers or the like in the printer section 12.

The exposure control section 65 controls the operation of the exposure device 21. Specifically, the exposure control section 65 controls an operation performed by the exposure device 21 to irradiate the photosensitive drum 31, serving as an image carrier, with a laser light to form an electrostatic latent image.

For example, the exposure control section 65 controls the emission of a laser light by the laser emitter 22 to control an operation of emitting a laser light having its light intensity varied in association with image data or the like. Further, the exposure control section 65 has a motor driver (not shown) that drivingly controls the polygon motor 24. The exposure control section 65 drivingly controls the polygon motor 24 to control rotation of the polygon mirror 23.

The development control section 66 forms a toner image by selectively supplying a black, cyan, magenta, or yellow toner to an electrostatic latent image formed on the photosensitive drum 31 by the black developing device 33 or color developing device 34.

The fixation control section 67 controls an operation of heating paper to which a toner image has been transferred by the fixing device 36, to melt the toner, while exerting a predetermined pressure on the paper to fix the toner to the paper.

Now, a description will be given of a warm-up operation performed when the color copier 1 configured as described above is powered on.

Figure 3:
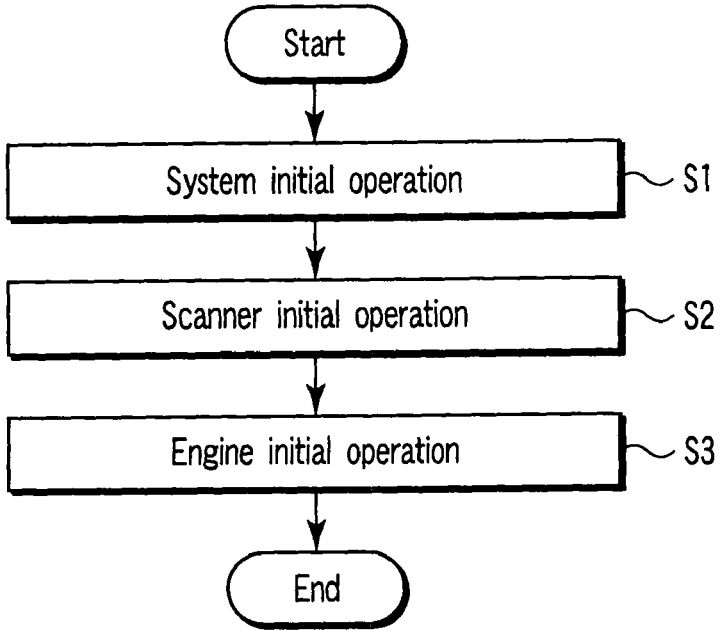

FIG. 3 is a flow chart illustrating the procedure of a warm-up operation when the color copier 1 is powered on (when a power source is started up).

When the power key 52*a* is turned on, the system control section 51 starts a warm-up operation accompanying the start-up of the power source of the color copier 1. During the warm-up operation, the system control section 51 of the color copier 1 first performs its own initial operation (start-up operation) (step S1). During the initial operation of the system control section 51, for example, the system control section 51 is connected to each section, the control panel 52 is checked for its operation, and various pieces of firmware in the system control section 51 are checked for their operations.

Once the initial operation of the system control section 51 is completed, the system control section 51 performs an initial operation of the scanner section 11 (step S2). During the initial operation of the scanner section 11, for example, the exposure lamp is checked for its lighting state, and a scanner motor is checked for its operation. Further, the output level of the CCD sensor is corrected, and various pieces of firmware in the scanner section 11 are checked for their operations.

Once the initial operation of the scanner section 11 is completed, the system control section 51 performs an initial operation of the printer section (engine) 12 (step S3). During the initial operation of the printer section 12, for example, the polygon motor 24 is started up for the image quality maintaining control, the fixing device 36 is warmed up, and the firmware in the printer section 12 and various driving motors are started up. Once the initial operation of the printer section 12 is completed, the color copier 1 enters a standby state and is ready for an image forming process.

Now, the initial operation of the printer section 12 will be described.

Figure 4:
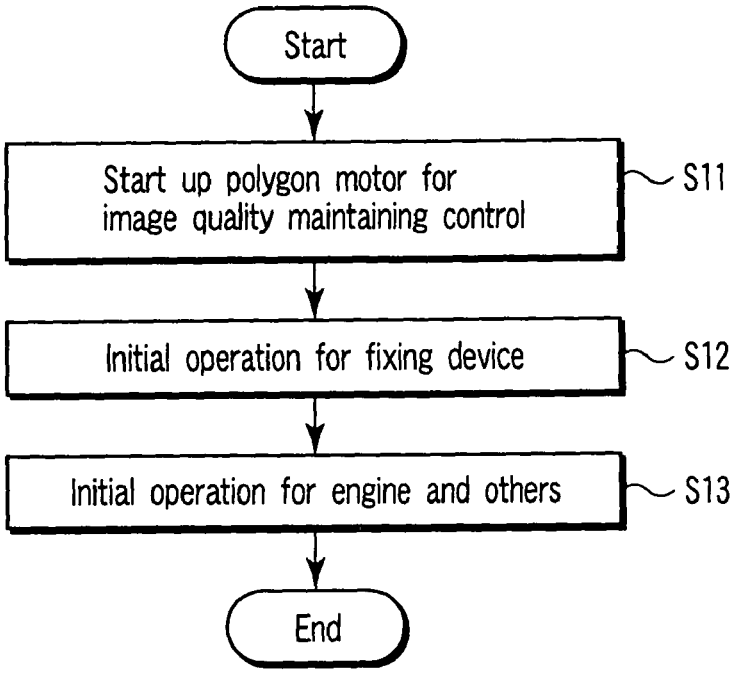

FIG. 4 is a flow chart illustrating the procedure of the initial operation of the printer section 12.

As shown in FIG. 4, during the initial operation of the printer section 12, the following operations are performed in the following order: an operation of starting up the polygon motor 24 for the image quality maintaining control (step S11), an operation of warming up the fixing device 36 (step S12), and an initial operation of the other components of the printer section 12 (step S13).

Accordingly, by reducing the time required to start up the polygon motor 24 in the step S11, it is possible to reduce the time required for the initial operation of the printer section 12 and for the initial operation of the entire color copier 1.

For example, during the initial operation upon power-on, the CPU 61 of the printer section 12 receives an instruction to start an initial operation from the system control section 51, to start an operation of starting up the polygon motor 24. During the operation of starting up the polygon motor 24, the polygon motor 24 rotates the polygon mirror 23 until the rotation speed of the polygon mirror 23 reaches a value corresponding to a resolution required to perform the image quality maintaining control. The polygon motor 24 then stabilizes the polygon mirror 23 at that rotation speed.

With the image quality maintaining control, the exposure device 21 writes a predetermined pattern on the photosensitive drum 31. Then, the developing device (black developing device 33 or color developing device 34) develops the pattern written on the photosensitive drum 31. The image quality maintaining sensor 37 then detects the density of the pattern developed. Then, on the basis of the result of the detection by the image quality maintaining sensor 37, the image quality is adjusted and maintained by adjusting the quantity of laser light from the laser light emitter 22 and the bias voltage provided by the charger 32.

A detailed description will be given below of the operation of starting up the polygon motor of the printer section 12 during the initial operation upon power-on.

First, a description will be given of the relationship between the rotation speed of the polygon mirror 23 and the time required to start up the polygon motor 24, which rotates the polygon mirror 23.

Figure 5:
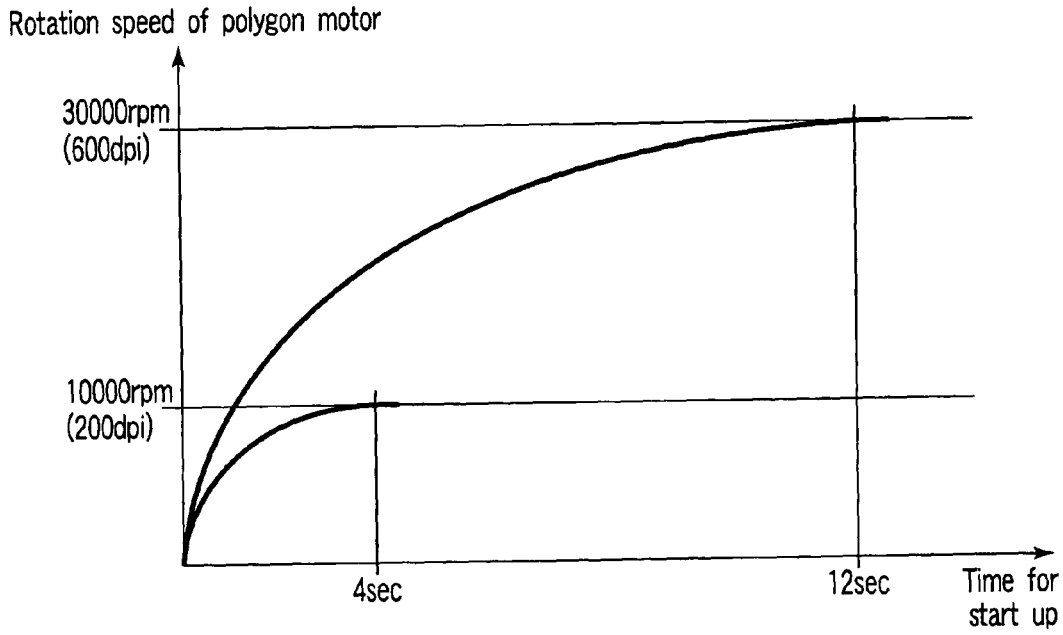
FIG. 5 is a graph showing the relationship between the rotation speed of a polygon mirror and the time required for an operation of starting up a polygon motor.

FIG. 5 is a graph showing the relationship between the time required to increase the rotation speed of the polygon mirror 23 from 0 to 30,000 rpm and the time required to increase the rotation speed of the polygon mirror 23 from 0 to 10,000 rpm.

In the example shown in FIG. 5, the rotation speed of the polygon mirror is set at 30,000 rpm to scan a laser light at 600 dpi. The rotation speed of the polygon mirror is set at 10,000 rpm to scan a laser light at 200 dpi. In this case, with an image forming apparatus in which an image is formed on the photosensitive drum 31, serving as an image carrier, by using a laser light scanned in the main scanning direction by the polygon mirror 23, rotated by the polygon mirror 24, the resolution of the image depends on the rotation speed of the polygon mirror 23.

That is, when the rotation speed of the polygon mirror 23 is set at 30,000 rpm, the present image forming apparatus can scan a laser light at a resolution of 600 dpi over the photosensitive drum 31 in the main scanning direction. On the other hand, when the rotation speed of the polygon mirror 23 is set at 10,000 rpm, the present image forming apparatus can scan a laser light at a resolution of 200 dpi over the photosensitive drum 31 in the main scanning direction.

Further, in the example shown in FIG. 5, 12 seconds is required to increase the rotation speed of the polygon mirror 23 from 0 to 30,000 rpm. Further, 4 seconds is required to increase the rotation speed of the polygon mirror 23 from 0 to 10,000 rpm.

In other words, in the example shown in FIG. 5, if the rotation speed of the polygon mirror 23 is set at 30,000 rpm for an initial operation upon power-on, 12 seconds is required for the operation of starting up the polygon motor 24 in order to increase the rotation speed of the polygon mirror 23 up to 30,000 rpm. On the other hand, if the rotation speed of the polygon mirror 23 is set at 10,000 rpm for the initial operation upon power-on, 4 seconds is required for the operation of starting up the polygon motor 24 in order to increase the rotation speed of the polygon mirror 23 up to 10,000 rpm.

Accordingly, by changing the rotation speed of the polygon mirror 23 from 30,000 to 10,000 rpm for the initial operation upon power-on, it is possible to reduce the time required to start up the polygon motor 24 by one-third. In other words, to reduce the time required to start up the polygon motor 24, it is possible to reduce the rotation speed of the polygon motor 24 (the rotation speed of the polygon mirror 23) upon power-on to allow the image quality maintaining control to be performed at a reduced resolution.

Now, description will be given of the relationship between the resolution corresponding to the rotation speed of the polygon mirror 23 and a pattern for image quality maintaining control.

Figure 6:
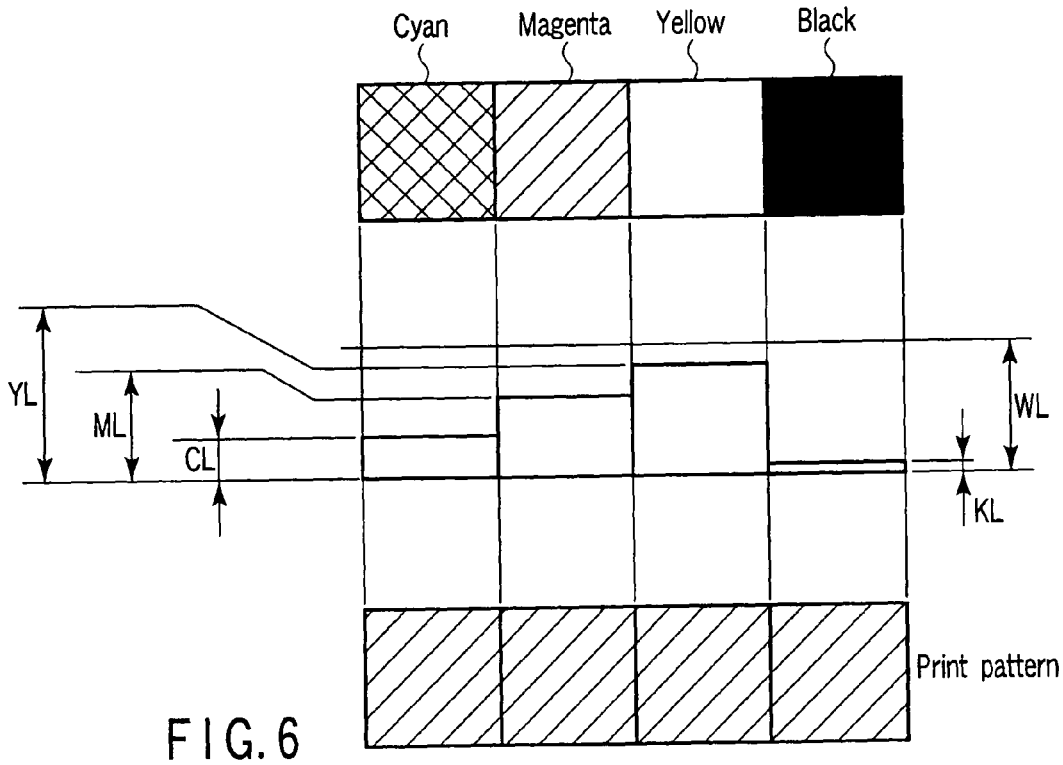
FIG. 6 is a diagram illustrating an example of image quality maintaining control.

FIG. 6 is a diagram illustrating an example of the image quality maintaining control applied to the image forming apparatus.

FIG. 6 shows an example of image patterns P developed using a cyan, magenta, yellow, and black toners and the detected density levels of the image patterns P developed using the respective toners.

The density (or luminance) levels of the image patterns P developed using the respective toners is detected by the image quality maintaining sensor 37 as, for example, a varying reflectance. Specifically, in the example shown in FIG. 6, an undeveloped part has a density level WL, and the image pattern P developed in cyan has a density level CL. The image pattern P developed in magenta has a density level ML, the image pattern P developed in yellow has a density level YL, and the image pattern P developed in black has a density level KL.

In the image quality maintaining control, the above image patterns are written on the photosensitive drum 31. Then, the image patterns P written on the photosensitive drum 31 are developed using the respective toners. The image quality maintaining sensor 37 then detects the density levels of the image patterns P developed using the respective toners. It is then determined whether or not each of the density levels detected by the image quality maintaining sensor 37 has a predetermined value. Then, on the basis of the result of the determination, the image quality is controlled (maintained).

Consequently, in the initial operation upon power-on, to write the above image patterns P on the photosensitive drum 31, it is necessary to set the rotation speed of the polygon mirror 23 at a value required for the image quality maintaining control, that is, a value required to write the image patterns P.

Now, description will be given of an image pattern P used for the image quality maintaining control in the present color copier 1.

Figure 7:
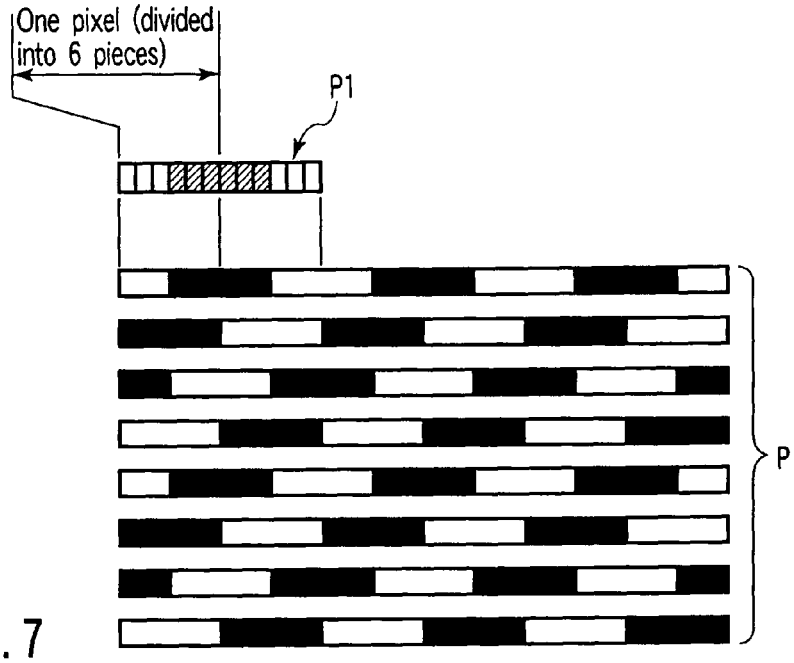
FIG. 7 is a diagram showing the configuration of a pattern used for the image quality maintaining control and an example of an image pattern obtained if the above pattern is written at a resolution of 600 dpi.

FIG. 7 shows the configuration of a pattern P1 for the image quality maintaining control and an example of an image pattern P formed by using the pattern P1 and rotating the polygon mirror 23 at a rotation speed of 30,000 rpm, corresponding to 600 dpi.

As shown in FIG. 7, in the pattern P1, one pixel is divided into six pieces, and an image is formed in three of the six pieces into which the pixel has been divided. Accordingly, for a resolution of 600 dpi, that is, if the polygon mirror 23 operates at a rotation speed of 30,000 rpm, the pattern P1 is written on the photosensitive drum 31 using a ⅗ (m/n) pixel. Thus, an image pattern P such as the one shown in FIG. 7 is written on the photosensitive drum 31.

Figure 8:
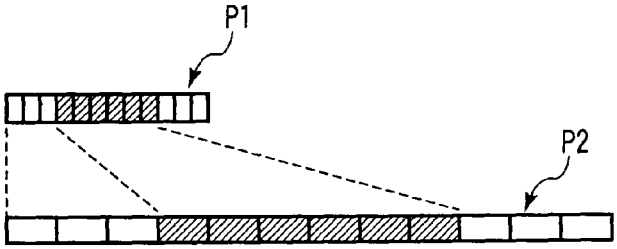
FIG. 8 is a diagram showing an example in which the pattern in FIG. 7 is written using a polygon mirror operating at a rotation speed corresponding to 200 dpi.

FIG. 8 is a diagram showing a pattern P2 written on the actual photosensitive drum 31 if the pattern P1 shown in FIG. 7 is formed by rotating the polygon mirror 23 at a rotation speed of 10,000 rpm, corresponding to 200 dpi.

As shown in FIG. 8, when the pattern P1 is formed using the polygon mirror 23 rotating at 10,000 rpm, it has its size tripled before being written on the photosensitive drum 31. In other words, when an image is formed in three of the six pieces of one pixel (one pixel at a resolution of 200 dpi) using the polygon mirror 23, which rotates at 10,000 rpm, corresponding to 200 dpi, an image obtained by enlarging the pattern P1 three times is formed on the photosensitive drum 31. As a result, a pattern P2 such as the one shown in FIG. 8 is written on the photosensitive drum 31 as an image pattern. Consequently, with the pattern P2 such as the one shown in FIG. 8, it is difficult to controllably adjust, in the image quality maintaining control, the level of quality of an image developed using each toner, to the correct value.

Figure 9:
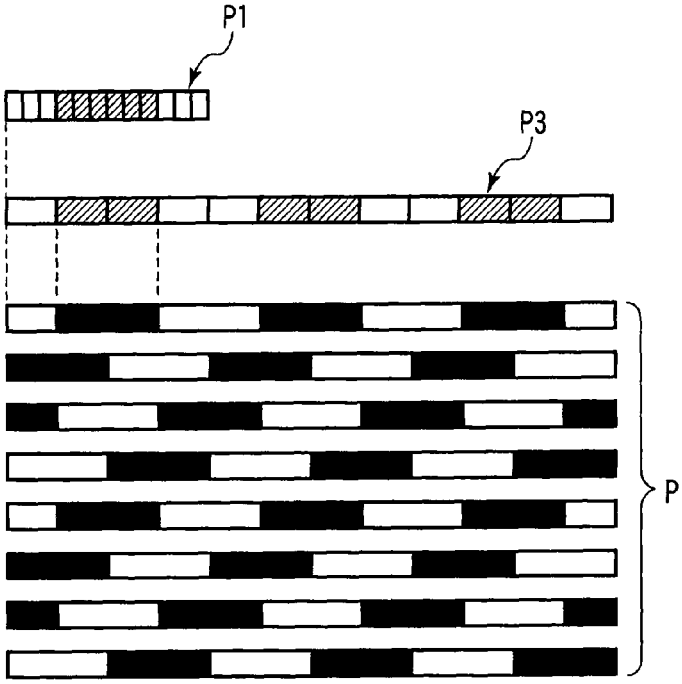
FIG. 9 is a diagram showing the configuration of a pattern used for the image quality maintaining control during the initial operation and an example of an image pattern obtained if the pattern is written at a resolution of 200 dpi.

FIG. 9 shows the configuration of a pattern P3 used for the image quality maintaining control and an example of an image pattern P formed by using the pattern P3 and rotating the polygon mirror 23 at a rotation speed of 30,000 rpm, corresponding to 200 dpi.

As shown in FIG. 9, in the pattern P3, used for the image quality maintaining control upon power-on, one pixel three times as large as that of the pattern P1 is divided into six pieces, and an image is formed in one of the six pieces so as to form an image pattern similar to that obtained using the pattern P1. Specifically, for a resolution of 200 dpi, that is, if the polygon mirror 23 operates at a rotation speed of 10,000 rpm, the pattern P3 is written on the photosensitive drum 31 using a ⅙ (1/n) pixel. Thus, an image pattern P such as the one shown in FIG. 9 and which is similar to the image pattern P shown in FIG. 7 is written on the photosensitive drum 31.

Conventional image forming apparatuses normally forming an image at a resolution of 600 dpi also performs the image quality maintaining control at a resolution of 600 dpi. The image quality maintaining control by such an image forming apparatus must write a pattern from the image quality maintaining control on the photosensitive drum 31 at 600 dpi. Consequently, during the initial operation, the rotation speed of the polygon mirror 23 must be set at 30,000 rpm, corresponding to 600 dpi.

In contrast, according to the present embodiment, even with an image forming apparatus forming an image at 600 dpi (the resolution for image formation), the image quality maintaining control during the initial operation upon power-on is performed at 200 dpi (which is lower than the resolution for image formation) using the pattern enabling the image quality maintaining control to be performed at 200 dpi.

Thus, the present color copier 1 makes it possible to reduce the time required to start up the polygon motor during the initial operation upon power-on. This reduces the time required for the initial operation of the printer section 12 and for the initial operation of the entire color copier 1.

For the patterns P1 and P3 for the image quality maintaining control, if the resolution for image formation is m times (for example, m=3 for 600/200) as high as that for image quality control, a pattern P3 is formed using a 1/n pixel at the resolution for image quality maintaining control (for example, a ⅙ pixel for 200 dpi). A pattern P1 is formed using an m/n pixel at the resolution for image formation (for example, a ⅙ pixel for 200 dpi).

Thus, the image pattern formed using the pattern P1 at the resolution for image formation is the same as the image pattern formed using the pattern P3 at the resolution for image quality maintaining control. That is, the same image pattern can be formed using either the resolution for image quality maintaining control or the resolution for image formation.

Consequently, during a warm-up operation performed when the image forming apparatus is powered on, the resolution for image quality maintaining control can be used to perform the image quality maintaining control at an accuracy comparable to that accomplished by the image quality maintaining control at the resolution for image formation. This reduces the time required for an operation of warming up the image forming apparatus.

As described above, the color copier according to the present invention performs the image quality maintaining control as an initial operation upon power-on at a resolution lower than that used by the color copier to form an image.

That is, the present color copier performs the image quality maintaining control as an initial operation upon power-on at the reduced resolution. Thus, the present color copier allows the polygon mirror 23 to be started up at a reduced rotation speed, the rotation speed depending on the resolution. Further, the present color copier can reduce the rotation speed of the polygon motor 24 upon power-on (the rotation speed upon start-up) and thus the time required to start up the polygon motor 24.

Moreover, the present embodiment performs the image quality maintaining control at a resolution lower than that for image formation upon power-on by applying a pattern for image quality maintaining control which corresponds to the resolution lower than that for image formation and which forms an image pattern similar to that allowing the image quality maintaining control at the resolution for image formation. This enables the image quality maintaining control to be accurately accomplished while reducing the time required to start up the polygon motor.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus which executes an image quality control, the apparatus comprising:

a light emitter which emits a laser light on a basis of the image quality control;

a polygon mirror which reflects the laser light;

an intermediate transfer member having an image quality control pattern formed by the laser light scanned in a main direction by the polygon mirror, transferred thereon;

a sensor which detects the density of the image quality control pattern formed on the intermediate transfer member; and a control section which controls the polygon mirror at a rotation speed corresponding to a resolution for image quality control lower than a resolution for image formation.

2. The image forming apparatus according to claim 1, further comprising a polygon motor which rotatatively drives the polygon mirror.

3. The image forming apparatus according to claim 1, further comprising:

an image carrier on which the image quality control pattern is formed by the laser light scanned in the main scanning direction by the polygon mirror; and a developing member which develops the image quality control pattern formed on the image carrier, wherein the image quality control pattern developed on the image carrier is transferred to the intermediate transfer member.

4. The image forming apparatus according to claim 3, wherein the sensor detects the image quality control pattern developed by the developing member to control image quality.

5. The image forming apparatus according to claim 1, wherein the control section controls image quality using the resolution for image quality control when a power source of the image forming apparatus is started up.

6. The image forming apparatus according to claim 1, wherein the resolution for image quality control is set so that an integral multiple of the resolution for image quality control is equal to the resolution for image formation.

7. The image forming apparatus according to claim 1, wherein the pattern for image quality control allows the same image pattern to be formed at the resolution for image formation and at the resolution for image quality control.

8. The image forming apparatus according to claim 1, wherein if the resolution for image formation is m times as high as the resolution for image quality control, the pattern for image quality control forms a pattern using a 1/n pixel at the resolution for image quality control and forms a pattern using a m/n pixel at the resolution for image formation.

9. A method of controlling image quality of an image forming apparatus, the method comprising:

emitting a laser light on a basis of the image quality control;

reflecting the laser light;

transferring an image quality control pattern onto an intermediate transfer member, the image quality control pattern formed by the laser light scanned in a main scanning direction;

detecting the density of the image quality control pattern on the intermediate transfer member to control image quality; and reflecting the laser light to correspond to a resolution for image quality control lower than the resolution for image formation.

10. The method of controlling image quality according to claim 9, further comprising reflecting the laser light by a polygon mirror and rotatatively driving the polygon mirror with a polygon motor.

11. The method of controlling image quality according to claim 9, further comprising:

forming the image quality control pattern on an image carrier by the laser light scanned in the main scanning direction by a polygon mirror; and developing the image quality control pattern formed on the image carrier, wherein the image quality control pattern developed on the image carrier is transferred to the intermediate transfer member.

12. The method of controlling image quality according to claim 9, further comprising developing the image quality control pattern.

13. The method of controlling image quality according to claim 9, further comprising controlling the image quality using the resolution for image quality control during a start up operation.

14. The method of controlling image quality according to claim 9, further comprising setting the resolution for image quality control such that an integral multiple of the resolution for image quality control is equal to the resolution for image formation.

15. The method of controlling image quality according to claim 9, further comprising allowing the image quality control pattern to form the same image pattern at the resolution for image formation and at the resolution for image quality control.

16. The method of controlling image quality according to claim 9, further comprising forming a pattern using a 1/n pixel at the resolution for image quality control and a m/n pixel at the resolution for image formation if the resolution for image formation is m times as high as the resolution for image quality control; and using the image quality control pattern to perform the forming the pattern step.

* * * * *